US007470075B2

(12) United States Patent
Kim

(10) Patent No.: US 7,470,075 B2
(45) Date of Patent: Dec. 30, 2008

(54) MULTIPURPOSE CASE

(76) Inventor: Joung chul Kim, 178-10 Nae-dong, Ojung-ku, Bucheon-si 421-160, Kyunggi-do (KR)

( * ) Notice: Subject to any disclaimer, the term of this patent is extended or adjusted under 35 U.S.C. 154(b) by 560 days.

(21) Appl. No.: 10/513,488

(22) PCT Filed: Apr. 24, 2003

(86) PCT No.: PCT/KR03/00824

§ 371 (c)(1),
(2), (4) Date: Jun. 23, 2005

(87) PCT Pub. No.: WO03/092432

PCT Pub. Date: Nov. 13, 2003

(65) Prior Publication Data

US 2005/0260024 A1 Nov. 24, 2005

(30) Foreign Application Priority Data

May 4, 2002 (KR) ..... 10-2002-0024592

(51) Int. Cl.
*B43K 7/12* (2006.01)

(52) U.S. Cl. ..... 401/117; 401/98

(58) Field of Classification Search ..... 401/116, 401/117, 55, 98, 75, 77, 78, 88
See application file for complete search history.

(56) References Cited

U.S. PATENT DOCUMENTS

| | | | | |
|---|---|---|---|---|
| 3,792,931 | A * | 2/1974 | Ganz | 401/109 |
| 5,102,249 | A * | 4/1992 | Holloway et al. | 401/78 |
| 5,257,704 | A * | 11/1993 | Gutt | 215/246 |
| 5,533,823 | A * | 7/1996 | Pierpont et al. | 401/98 |
| 5,876,137 | A * | 3/1999 | Byrd | 401/78 |
| 6,186,686 | B1 * | 2/2001 | Neuner et al. | 401/75 |
| 6,341,911 | B1 * | 1/2002 | Shueh | 401/6 |

* cited by examiner

*Primary Examiner*—David J Walczak
(74) *Attorney, Agent, or Firm*—Booth Udall, PLC

(57) ABSTRACT

Disclosed is a multipurpose case used as a case of cosmetic tools or stationery materials which allows withdrawal of cosmetic tools or stationery materials as required by a user. The multipurpose case has a simple structure and a core accommodated in the multipurpose case may be withdrawn at once. The multipurpose case includes a core fixing section, to which first and second tubes are coupled from upper and lower portions thereof. A third tube is arranged between the first and second tubes and the core fixing section is coupled to a lower end of the third tube. When the third tube is moved up, the core fixing section is simultaneously moved up, so that the core provided at an upper end of the core fixing section is easily withdrawn to an exterior. The multipurpose case having the simple structure reduces the manufacturing cost and improves the convenience of use by allowing for easy withdrawal of the core.

8 Claims, 16 Drawing Sheets

MULTIPURPOSE CASE

TECHNICAL FIELD

The present invention relates to a multipurpose case, more particularly to a multipurpose case used as a housing of a cosmetic tool, such as a brush set including a lip brush and a blusher brush, or used as a housing of a ball-point pen, a color pencil, a blade, a gimlet, and a pastel crayon, capable of allowing slidable withdrawal of the above elements at once while having a simple construction.

BACKGROUND ART

In general, various kinds of brushes are widely available for cosmetic use. The brushes are comprised of a bar and a brush member or eyeliner formed at one end of the bar. The brushes are stored in a brush bag without a case.

For example, as shown in FIG. 1, the brush includes a bar SC made of metal and a brush member Br such as a blusher brush or eyeliner fixedly formed at one end of the bar SC. A plurality of brushes are stored in a brush bag (not shown). A user selectively uses the brush for making-up the face of the user and stores the brush again in the brush bag after completing the making-up.

However, the brush member fixed at one end of the bar is exposed to an exterior, so it is inconvenient for the user to carry the brush. In addition, cosmetic powder sticking to the brush member may contaminate an interior part of the brush bag. Furthermore, the brush member is easily damaged when it makes contact with other objects, so the life span of the brush member is shortened.

FIG. 2 shows a lip liner, which is a kind of conventional cosmetic tool. As shown in FIG. 2, the lip liner includes an upper case 1 formed at an inner portion thereof with a plurality of linear guide slots 2, a core fixing section 103 formed at one end thereof with a guide protrusion 6 for allowing the core fixing section 103 to move along the linear guide slots 2 and formed at the other end thereof with a engagement protrusion 7 having a spiral protuberance 9, and a lower case 3 formed at an inner portion thereof with a spiral groove 4.

In the figure, the lip liner core 8 (lip liner pencil) is vertically inserted into an upper portion of the guide protrusion 6 and the engagement protrusion 7 formed at a lower end of the guide protrusion 6 is inserted into the lower case 3 so that the spiral groove 4 is meshed with the spiral protuberance 9. In addition, the guide protrusion 6 is engaged with the linear guide slot 2 formed in the upper case so that the guide protrusion 6 may be moved up and down linearly.

When using the lip liner, a user firstly rotates the body 100 of the lip liner while manually gripping the upper case 1. At this time, the engagement protrusion 7 having the spiral protuberance 9 moves up along the spiral groove 4 so that the core fixing section 103 moves up.

If the core fixing section 103 moves up, the lip liner core 8 fixed to the guide protrusion 6 of the core fixing section 103 is linearly moved up due to the guide protrusion 6 engaged with the linear guide slot 2.

The downward movement of the lip liner core 8 is the reverse of the upward movement of the lip liner, so it will not be further described below.

As mentioned above, the conventional lip liner structure includes a short spiral protrusion formed at an outer portion of the core fixing section 103 and a long spiral slot formed at an inner portion of the lower case 3. Such a lip liner structure is not only used for lip liners, but also used for other cosmetic tools or stationery materials.

However, it is very difficult to form the spiral slots in the inner portion of the lower case, so the productivity of the lip liner is lowered. In addition, it takes a long time to assemble the lip liner.

DISCLOSURE OF THE INVENTION

Therefore, the present invention has been made in view of the above-mentioned problems, and it is an object of the present invention to provide a multipurpose case assembled in a simple manner and capable of easily withdrawing a core accommodated therein.

Another object of the present invention is to provide a multipurpose case capable of preventing a core accommodated therein from being exposed to an exterior.

Still another object of the present invention is to provide a multipurpose case, which may be used as a case for a wide range of cosmetic tools or stationery materials.

According to an aspect of the present invention, there is provided a multipurpose case comprising: a first supporting section coupled to a first tube having a cylindrical shape with a predetermined length; connection members vertically extending upwards from both sides of an upper surface of the first supporting section; a second supporting section formed at upper ends of the connection members and inserted into a second tube having an outer diameter smaller than an outer diameter of the first tube; and a core fixing section coupled to a third tube arranged between the first and second tubes coupled to the case so as to withdraw the core provided at an upper end thereof to the exterior.

The core fixing section includes a guide member formed at both sides thereof with guide slots for allowing the core fixing section to move along the connection members, a vertical member vertically connected to a center of the guide member while passing through a center of the second supporting section, and a supporting member formed at an upper end of the vertical member so as to be coupled with a core supporting section containing the core.

A lid is coupled to an outer peripheral portion of the third tube provided in the core fixing section.

According to another aspect of the present invention, there is provided a multipurpose case used as a case for cosmetic tools and including an upper lid, a middle case and a lower case, the multipurpose case comprising: a fixing member formed at both sides thereof with guide slots, which are vertically formed, and having a plurality of engagement protrusions formed at one side of the guide slots; a core fixing section including an upper body for fixing a core thereto and a lower body formed at a lower portion of the upper body and having wings, the core fixing section being coupled to the fixing member such that the wings are moved along the guide slots; and an upper fixing cap fixed to an inner ceiling surface of the upper lid and including a touch part making contact with an upper peripheral portion of the fixing member so as to seal the fixing member.

According to the preferred embodiment of the present invention, a plurality of slits are formed at an outer peripheral portion of an upper end of the middle case so as to allow a user to easily withdraw the core by using one hand.

The touch part is protruded radially inwards so as to seal the fixing member by making contact with the fixing member and made of rubber or silicon.

The core may be any one selected from the group consisting of a lip liner, a lipstick, a stick foundation, and a blusher brush.

The core may also be any one selected from the group consisting of a ball-point pen, a pastel crayon, a color pencil, a blade and a gimlet.

BRIEF DESCRIPTION OF THE DRAWINGS

The foregoing and other objects, features and advantages of the present invention will become more apparent from the following detailed description when taken in conjunction with the accompanying drawings in which.

BEST MODE FOR CARRYING OUT THE INVENTION

Figure 1:
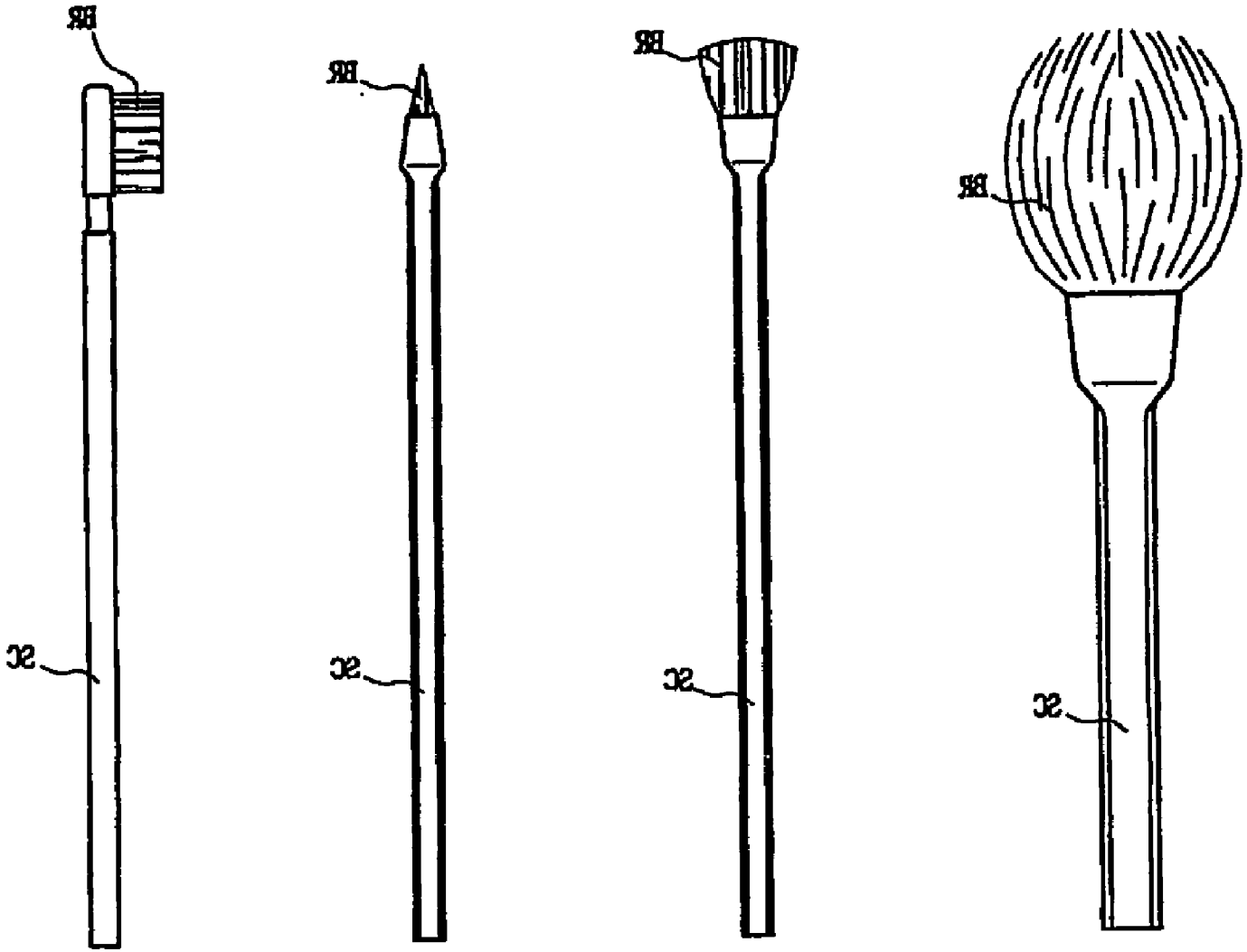
FIG 1 (Prior Art)
FIG. 1 is a side view of conventional cosmetic brushes.
Figure 2:
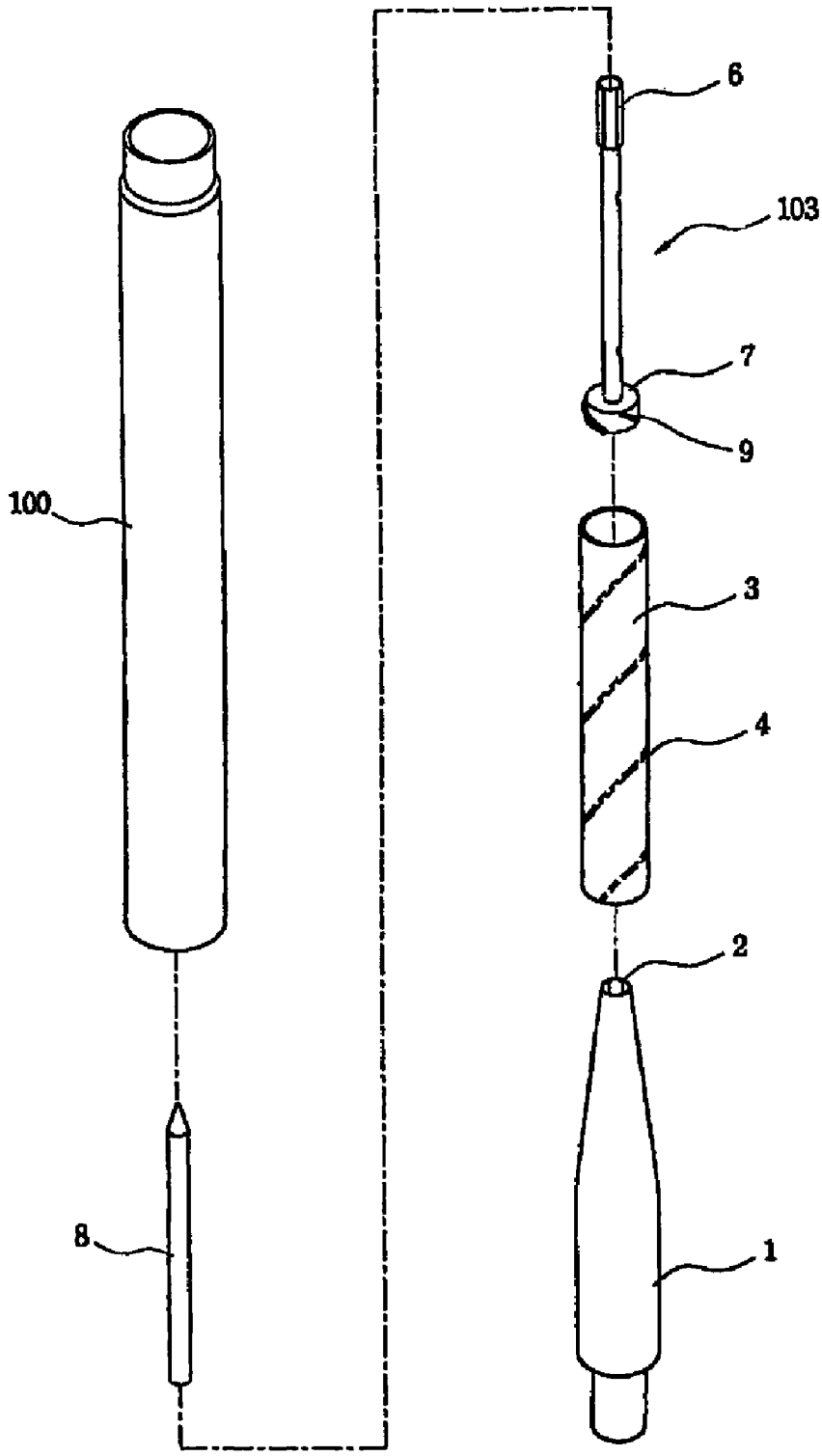
FIG 2 (Prior Art)
FIG. 2 is an exploded perspective view showing a conventional multipurpose case.

Reference will now be made in detail to the preferred embodiments of the present invention.

FIGS. 3 to 5B are views showing a multipurpose case according to one embodiment of the present invention and an assembling process thereof. FIGS. 6 to 8B are views showing various embodiments of a multipurpose case according to other embodiments of the present invention.

A multipurpose case 10 of the present invention is divided into upper and lower parts as shown in the drawings.

Figure 3:
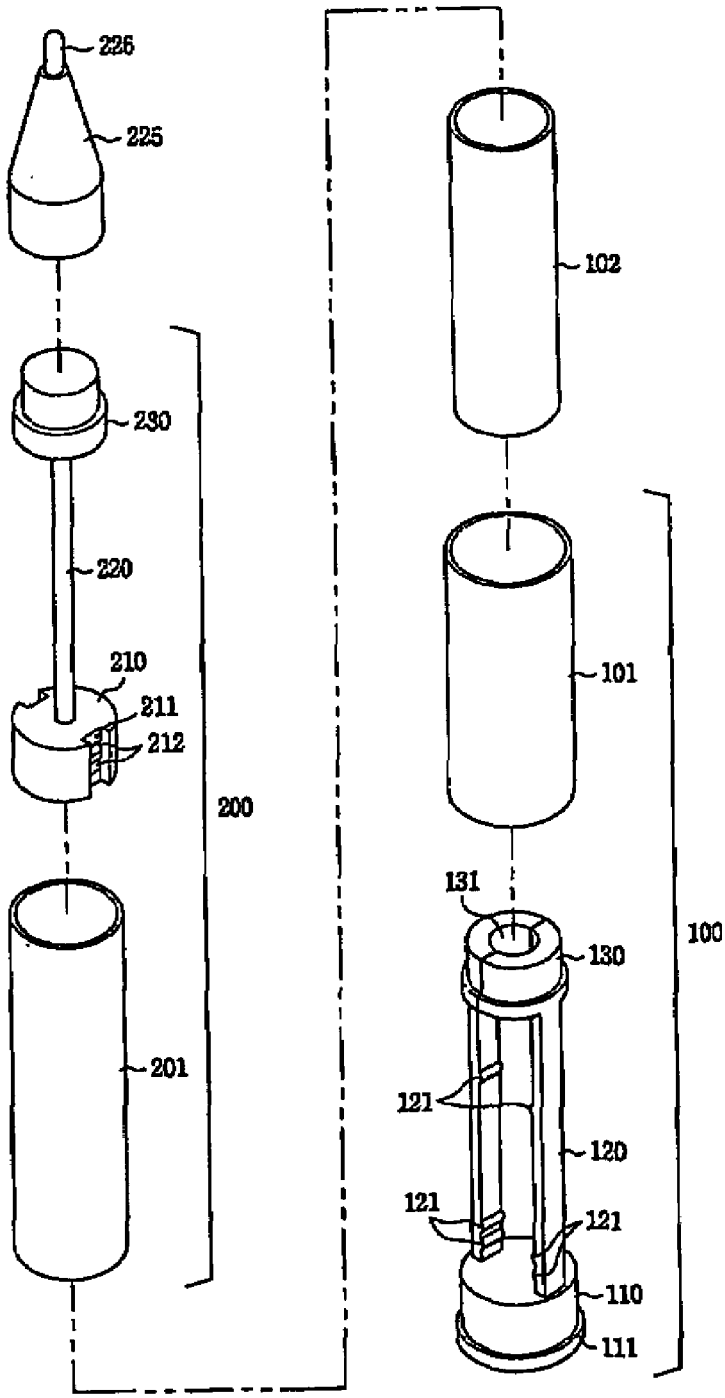
FIG. 3 is an exploded perspective view showing a multipurpose case according to one embodiment of the present invention.

Referring to FIG. 3, the multipurpose case 10 of the present invention mainly includes a case 100 and a core fixing section 200 formed at an upper end thereof with a core 226 (pencil) and slidably moved up and down within the case 100

A first supporting section 110 is formed at a lower portion of the case 100 and a stepped portion 111 is formed at a lower portion of the first supporting section 110. A first tube 101 having a predetermined length is coupled to an outer surface of the first supporting section 110. The first tube 101 is fixed to the stepped portion 111.

A pair of connection members 120 are vertically installed on an upper portion of the first supporting section 110 and engagement protrusions 121 are integrally formed at an inner portions of the connection members 120 in order to fix a guide member 210.

A second supporting section 130 is formed at upper ends of the connection members 120. An outer diameter of the second supporting section 130 is smaller than a distance between the connection members 120, which are vertically extend from the upper portion of the first supporting section 110. A second tube 102 is arranged around the second supporting section 130.

The second supporting section 130 is divided into two parts corresponding to the connection members 120, and a perforation hole 131 is formed at a center of the second supporting section 130. Due to the perforation hole 130 formed at the center of the second supporting section 130, a vertical member 220 of the core fixing section 200 is easily assembled into the case 100 and easily moved up and down.

The guide member 210 is formed at a lower portion of the core fixing section 200. The guide member 210 is installed at an upper portion of the first supporting section 110. Guide slots 211 are formed at both sides of the guide member 210. The connection members 120 are accommodated in the guide slots 211 so that the core fixing section 200 can be vertically moved up and down.

Engagement slots 212 to be engaged with the engagement protrusions 121 of the connection members 120 are provided in the guide slots 211 formed at both sides of the guide member 210 so as to prevent the core 226 from being downwardly moved.

An outer diameter of the guide member 210 is smaller than the distance between the connection members 120, which are vertically installed on the upper portion of the first supporting section 110, so a third tube 201, into which the guide member 210 is inserted, can be moved upwards without being interrupted with the connection members 120.

The vertical member 220 is vertically formed at a center of the guide member 210 and a supporting member 230 is provided at an upper end of the vertical member 220. A core supporting member 225 is coupled to the supporting section 230 so as to prevent the core 226 from being moved.

In addition, a lid can be coupled to an outer peripheral portion of the third tube 201 as required by a user.

Although the multipurpose case 10 shown in FIG. 3 has a cylindrical shape, it can be modified into another shapes. According to other embodiments of the present invention, the multipurpose case 10 may have a triangular sectional shape, a polygonal sectional shape or an oval sectional shape.

Hereinafter, an assembling process and an operation of the multipurpose case 100 will be described with reference to FIGS. 4A to 5B.

Figure 4A:
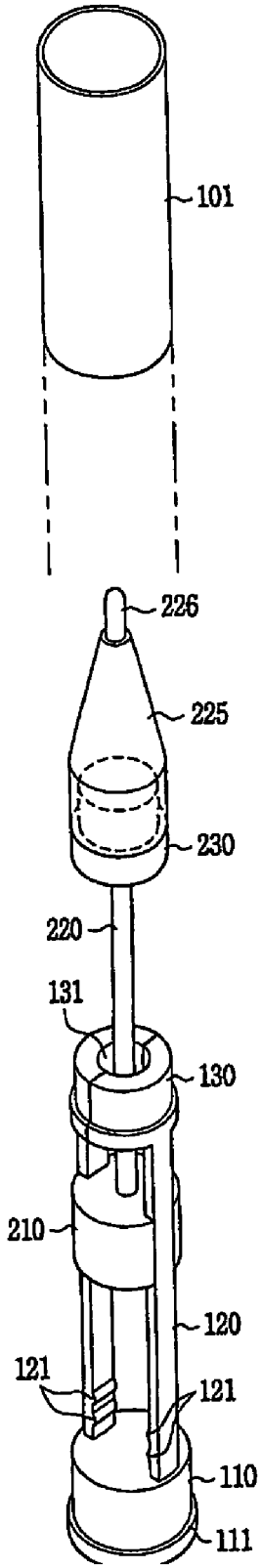
FIGS. 4A to 4C are exploded perspective views showing assembling processes of a multipurpose case according to one embodiment of the present invention.

Referring to FIG. 4A, the vertical member 220 of the core fixing section 200 is positioned in the perforation hole 131 by widening a space between two parts of the second supporting section 130, which is integrally formed with the connection members 120 vertically installed on the upper portion of the first supporting section 110.

At this time, the connection members 120 are arranged in match with the guide slots 211 of the guide member 210 in such a manner that the guide member 210 moves up and down along the connection members 120. Then, the first tube 101 is coupled to an upper portion of the first supporting section 110.

Figure 4B:
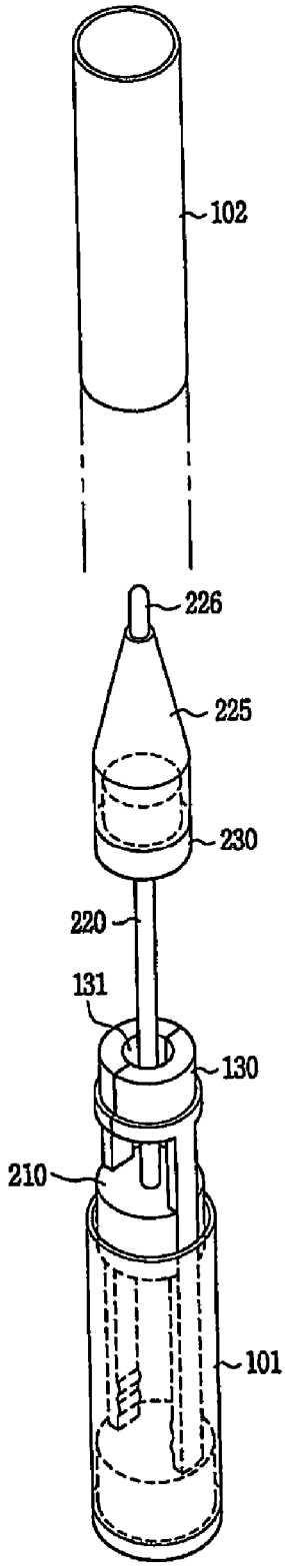

In addition, as shown in FIG. 4B, the second tube 102 is coupled to an upper end of the second supporting section 130 so as to prevent two parts of the second supporting section from being separated from each other.

Figure 4C:
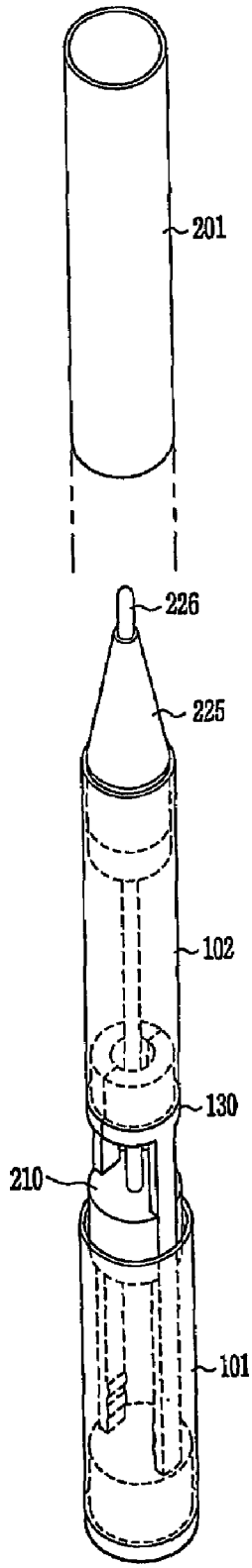

Then, as shown in FIG. 4C, the third tube 201 is assembled around the guide member 210 such that the third tube 201 surrounds the first and second tubes 101 and 102, which are coupled to the first and second supporting sections 110 and 130, thereby completing the assembling process.

Figure 5A:
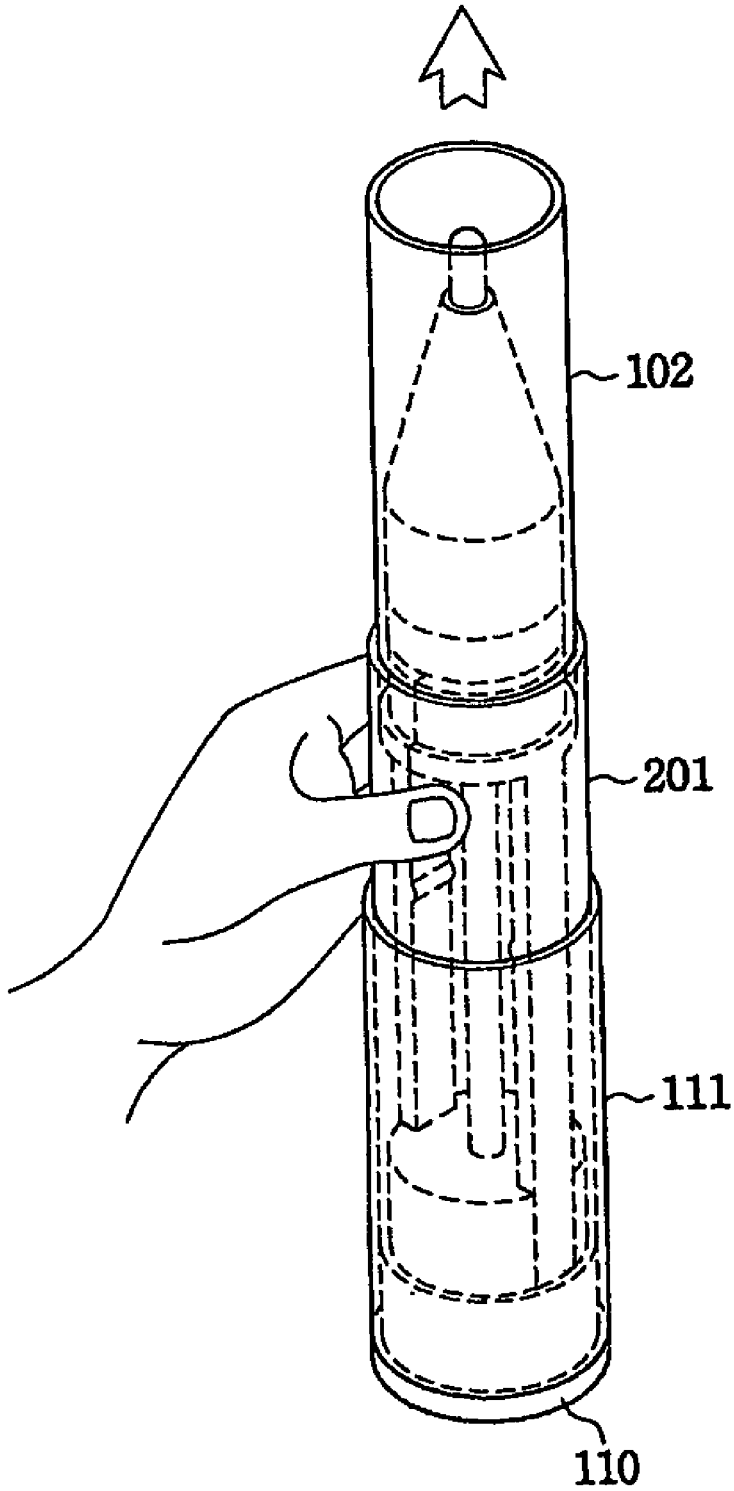
FIGS. 5A and 5B are perspective views showing an operation of a multipurpose case according to one embodiment of the present invention.

Hereinafter, the operation of the multipurpose case 10 will be described in detail with reference to FIGS. 5A and 5B.

Figure 5B:
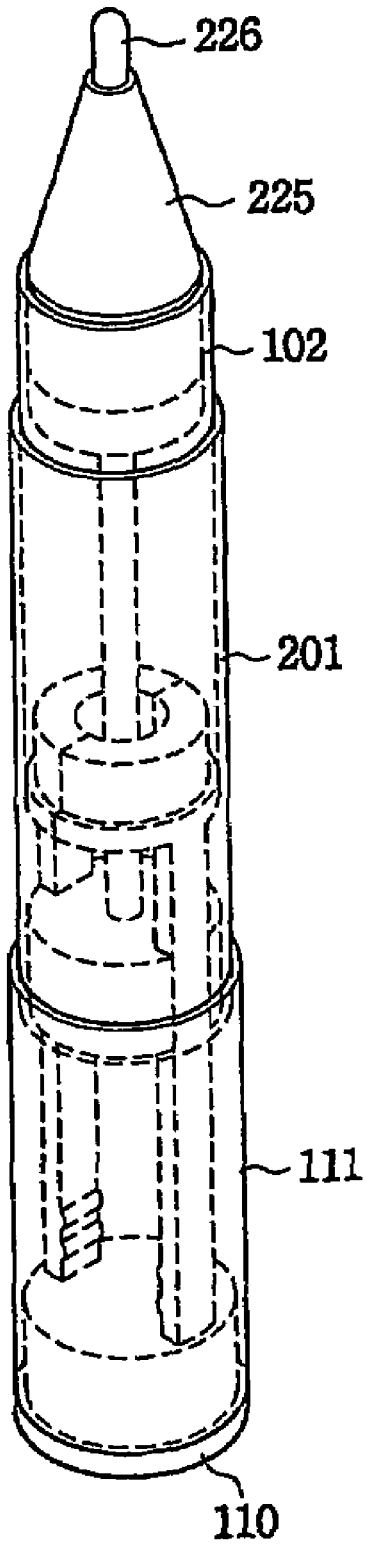

Firstly, in order to withdraw the core 226 accommodated in the core fixing section 200, a user grips the first tube 101 of the case 100 shown in FIG. 5 using one hand, and pulls upward the third tube 201 by gripping an upper portion of the third tube 201 using the other hand. Thus, as shown in FIG. 5B, the core fixing section 200 coupled to a lower end of the third tube 201 is protruded into an upper portion of the second tube 102 so that the user can use the core 226 provided at the upper end of the core fixing section.

At this time, since the guide slots 211 formed at both sides of the guide member 210 are engaged with the connection members 120, the guide member 210 can be vertically guided between the connection members 120. In addition, while the guide member 210 is vertically guided, the engagement slots 212 formed in the guide slots 211 can be engaged with the engagement protrusions 121 of the connection members 120, thereby preventing movement of the guide member 120 during use of the core 226.

On the other hand, the multipurpose case can be used as a case of cosmetic tools and stationery materials, if the user exchanges the core 226 of the core supporting member 225 with a color pencil, a pastel crayon, solid paste, a lip brush, an eye brush and a blusher brush.

Figure 6:
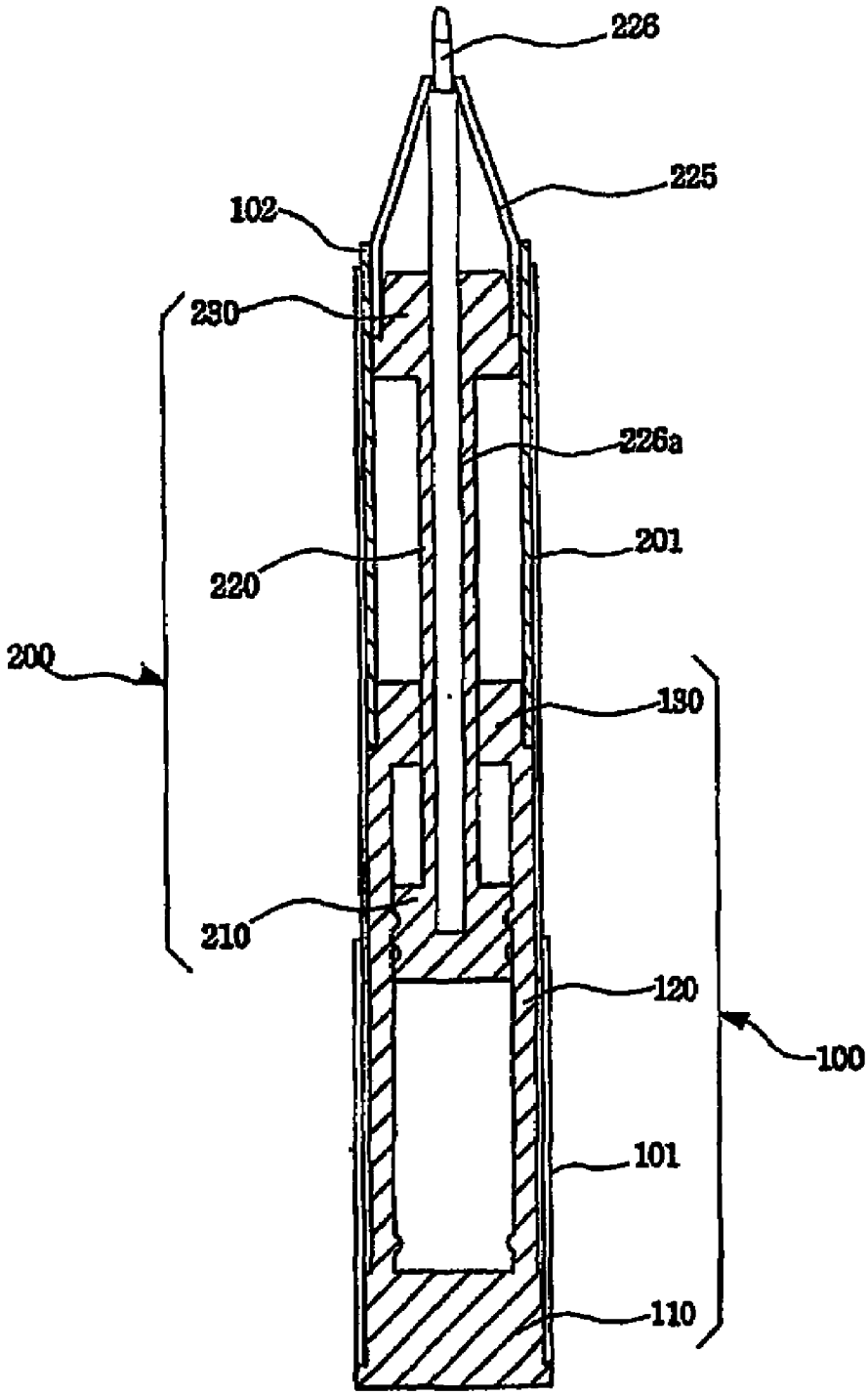
FIG. 6 is a side sectional view showing a multipurpose case according to another embodiment of the present invention.
Figure 7A:
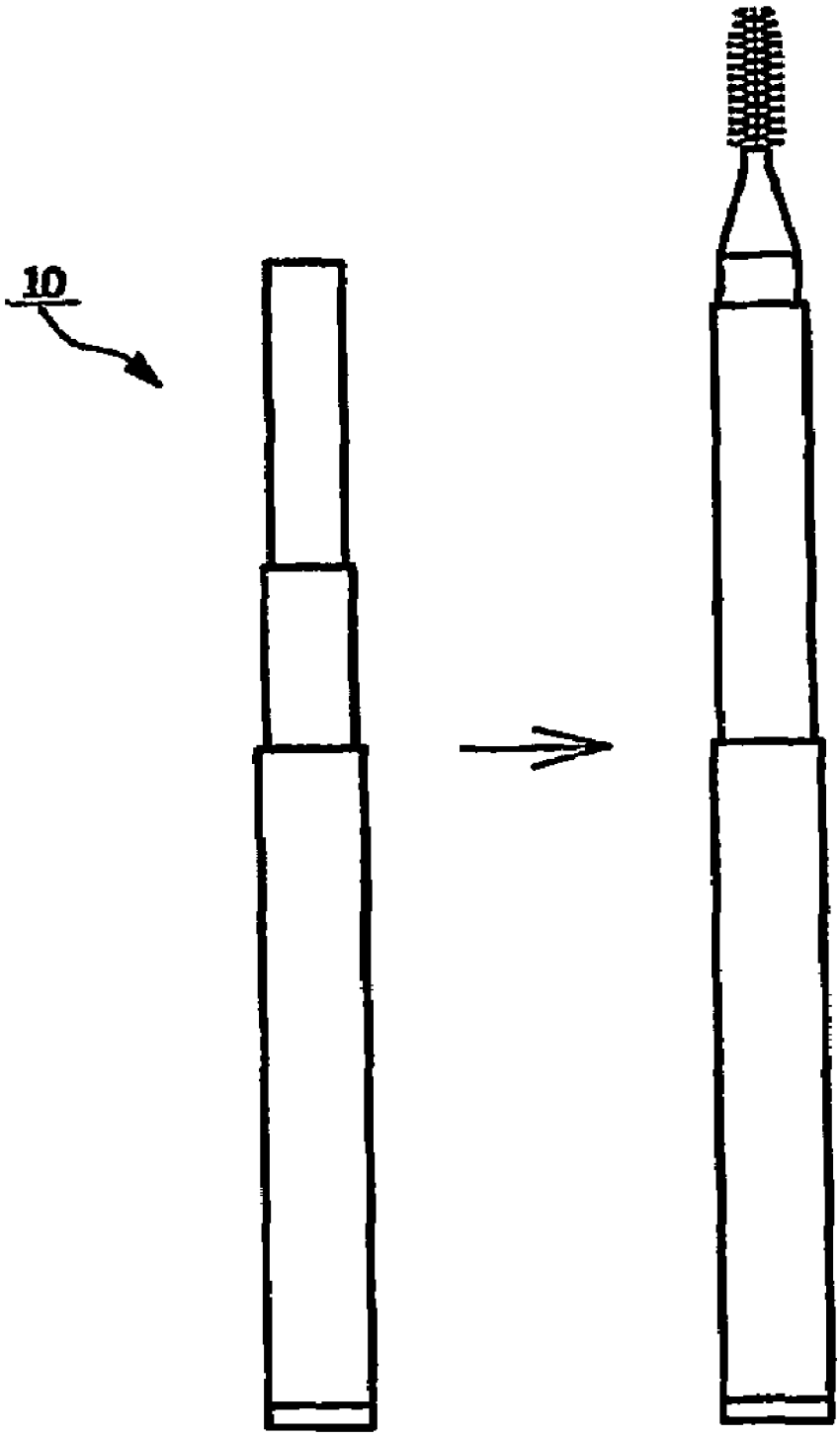
FIGS. 7A to 8B are side views of multipurpose cases according to various embodiments of the present invention.
Figure 7B:
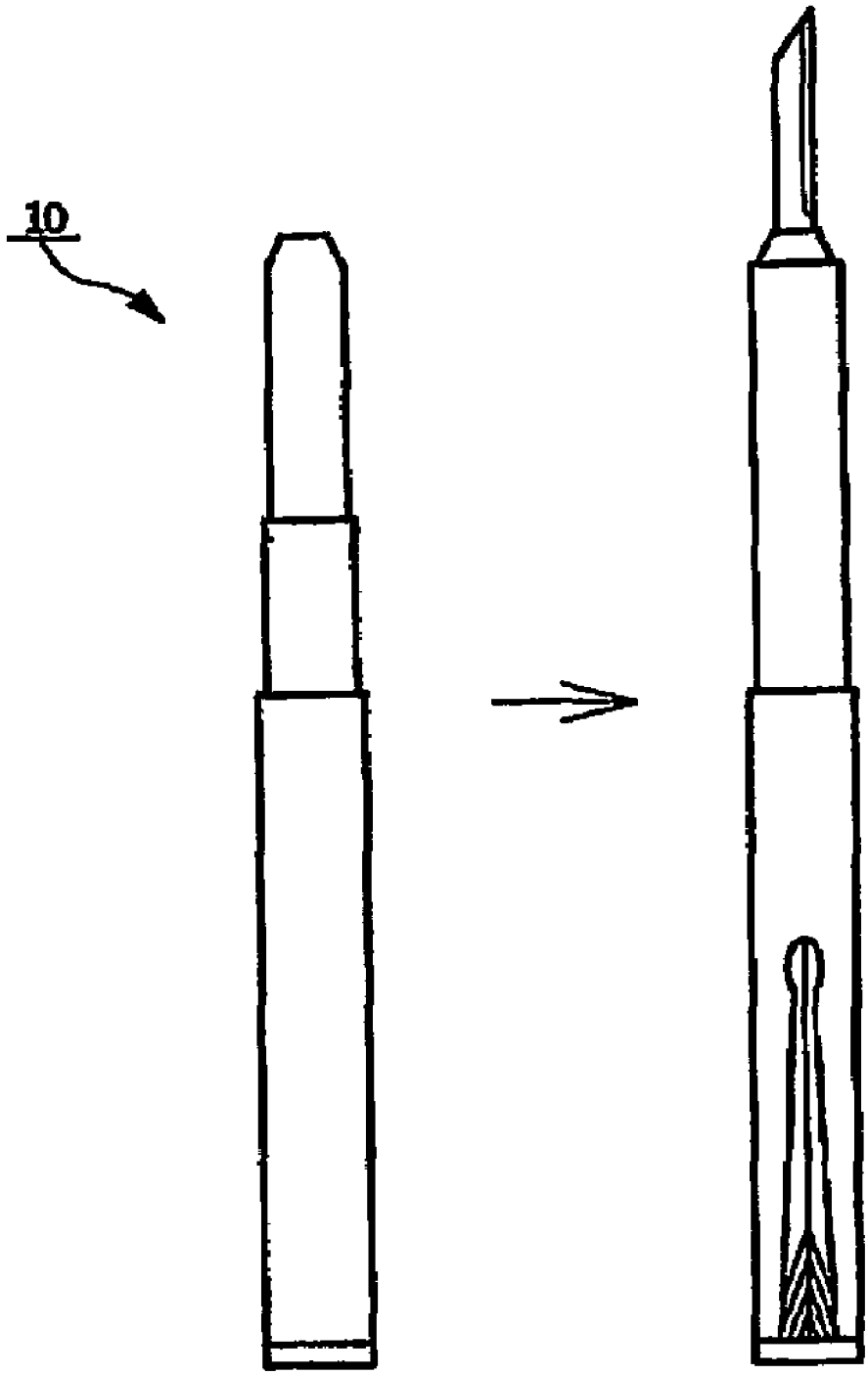
Figure 8A:
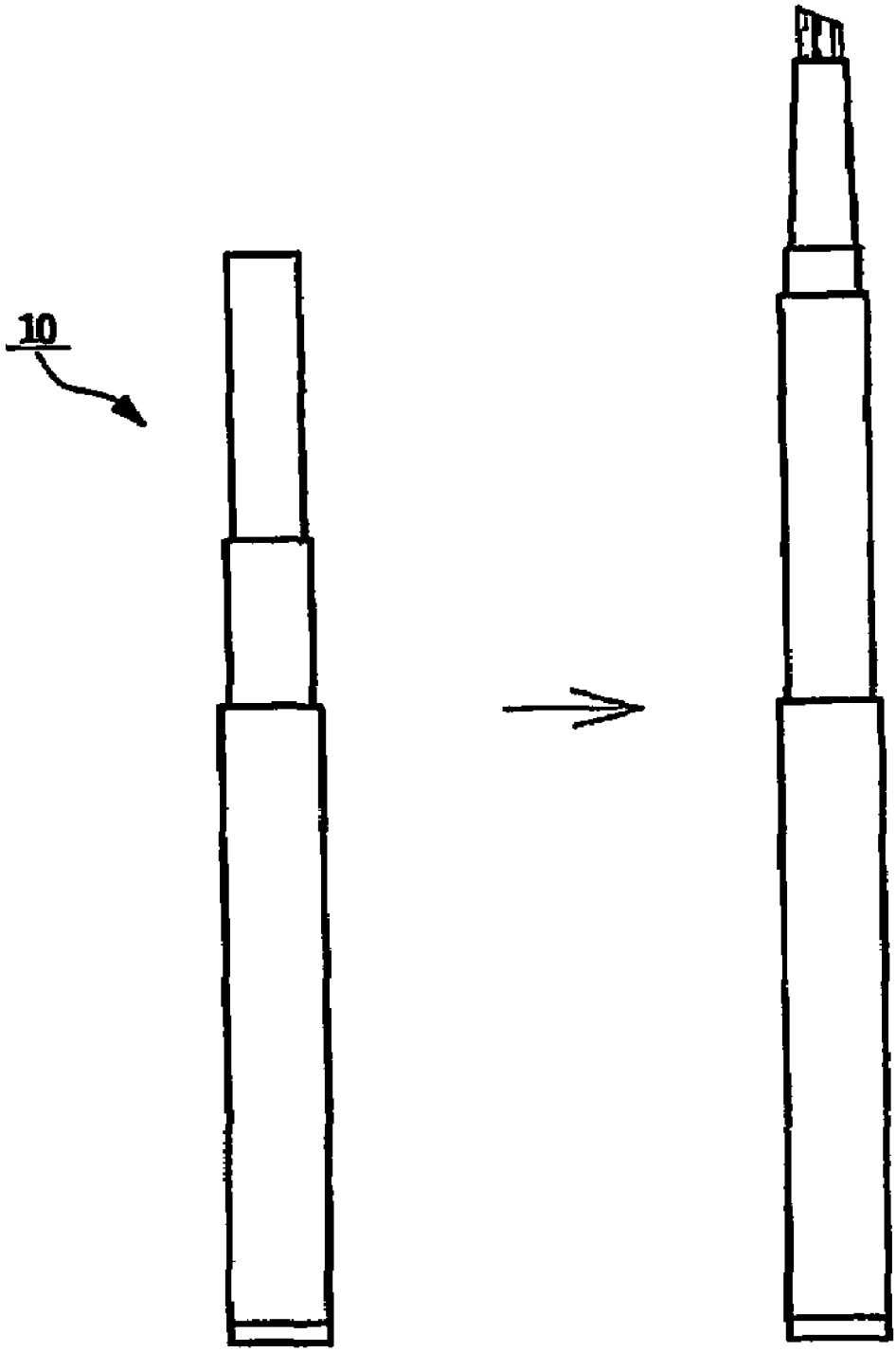
Figure 8B:
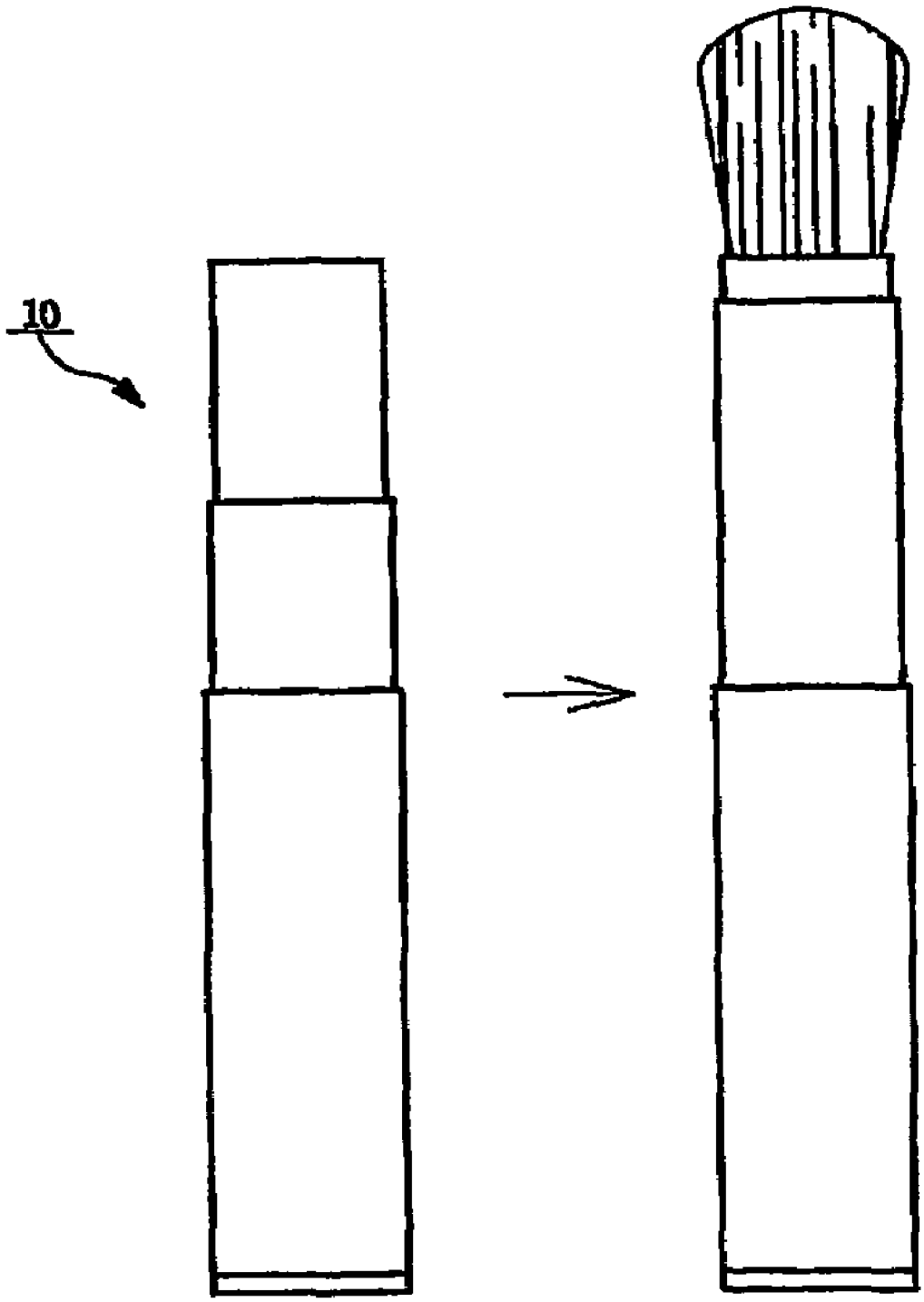

FIG. 6 shows a multipurpose case 10 according to another embodiment of the present invention used as a case of a ball-point pen, in which the core 226 fixed in the core fixing section 200 is a pencil of the ball-point pen. The structure of the multipurpose case 10 shown in FIG. 6 is identical to the structure of the multipurpose case 10 shown in FIG. 3 except for a pencil supporting hole 226*a* formed at a center of the core fixing section so as to support the core (pencil) 226.

The pencil supporting hole 226 can be easily fabricated through a die-casting process by modifying a shape of a mold.

That is, the multipurpose case according to the present invention can be used as a case of stationery materials, such as a ball-point pen, a blade, and a gimlet, and as a case of cosmetic tools, such as a brush set.

FIGS. 7A to 8B are views showing various embodiments of the present invention, where various kinds of cores 226 are provided in the multipurpose case depending on the various shapes of the core supporting member 225. Referring to FIGS. 7A to 8B, cores 226 are stored in the multipurpose case when they are not used and withdrawn from the multipurpose case for use.

Since the core 226 is hidden in the multipurpose case or protruded from the multipurpose depending on an operation of the core fixing section 200, which is slidably moved up and down within the case 100, the multipurpose case can be safely stored in a bag without contaminating the bag. In addition, the core is prevented from making contact with another objects when it is stored in the bag, so the life span of the core can be extended. The multipurpose case of the present invention can be used for a case of a brush, a blade and a gimlet, while improving the reliability thereof.

Figure 9:
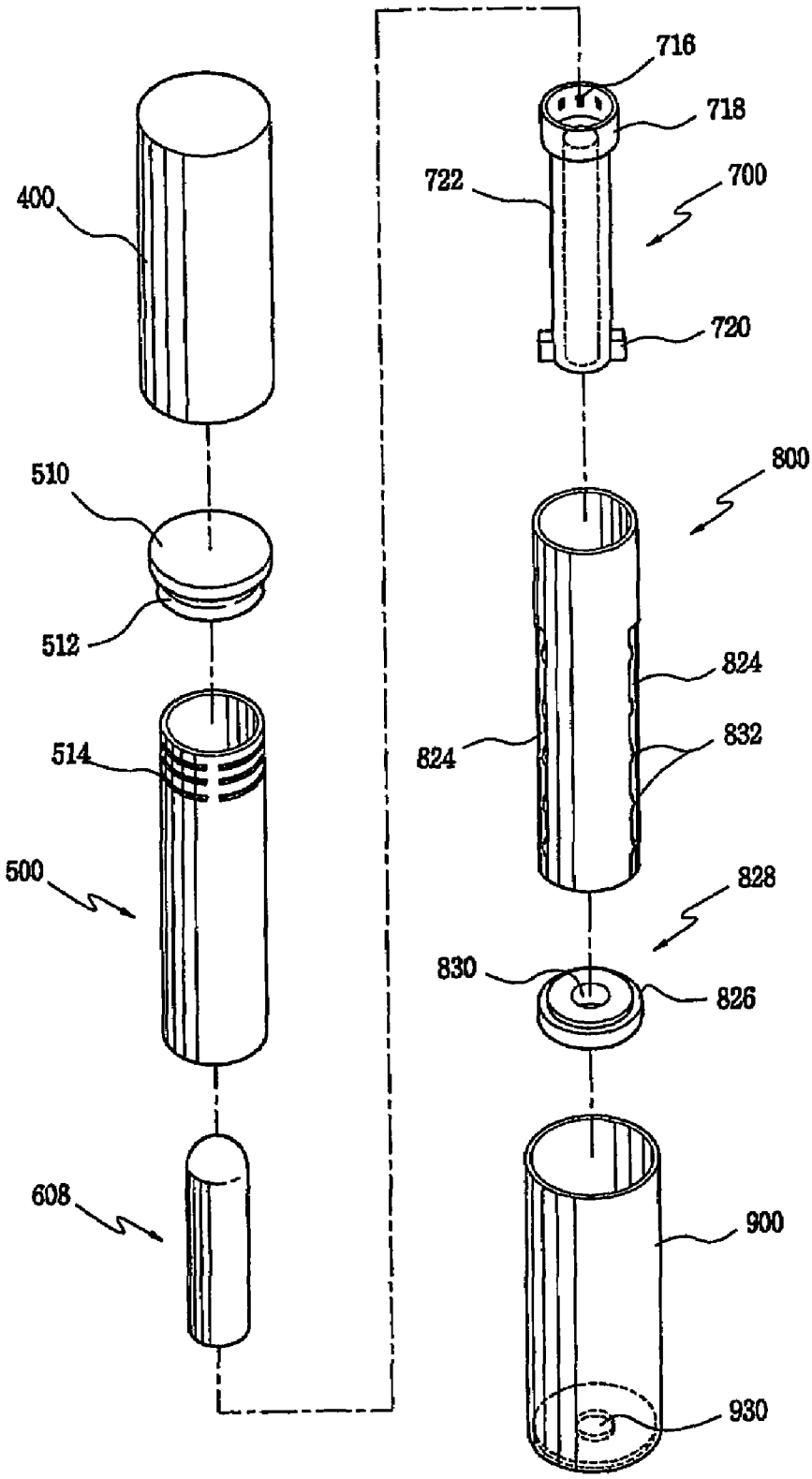
FIG. 9 is an exploded perspective view showing a multipurpose case according to another embodiment of the present invention.
Figure 10:
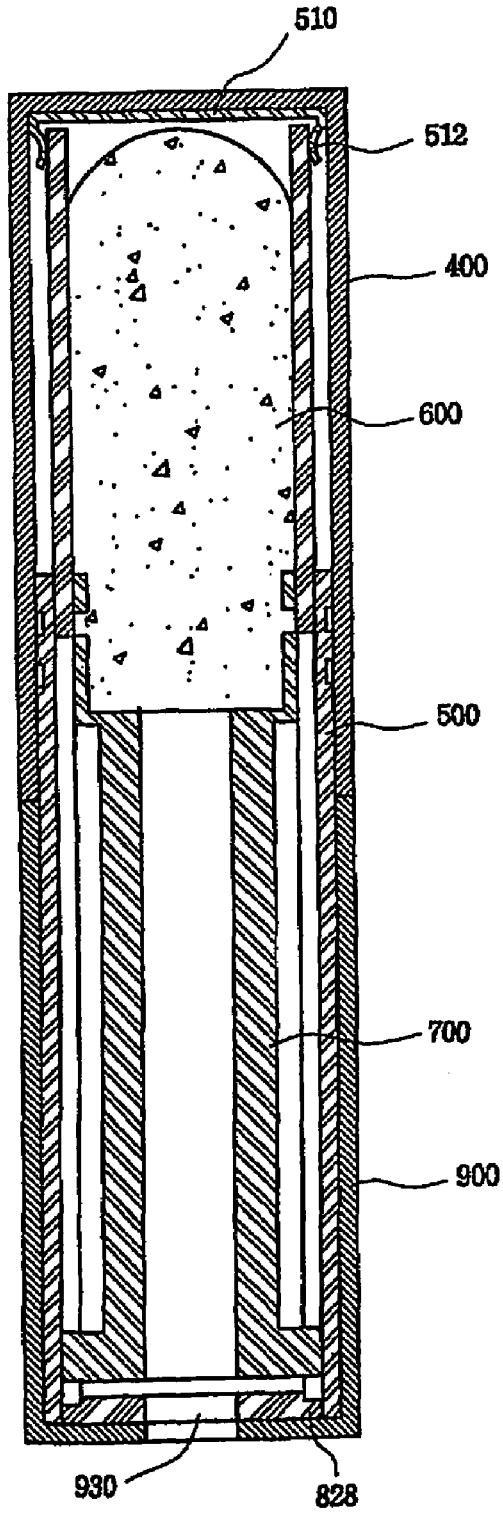
FIG. 10 is a side sectional view of the multipurpose case shown in FIG. 9 when the multipurpose case is in an assembling state.
Figure 11:
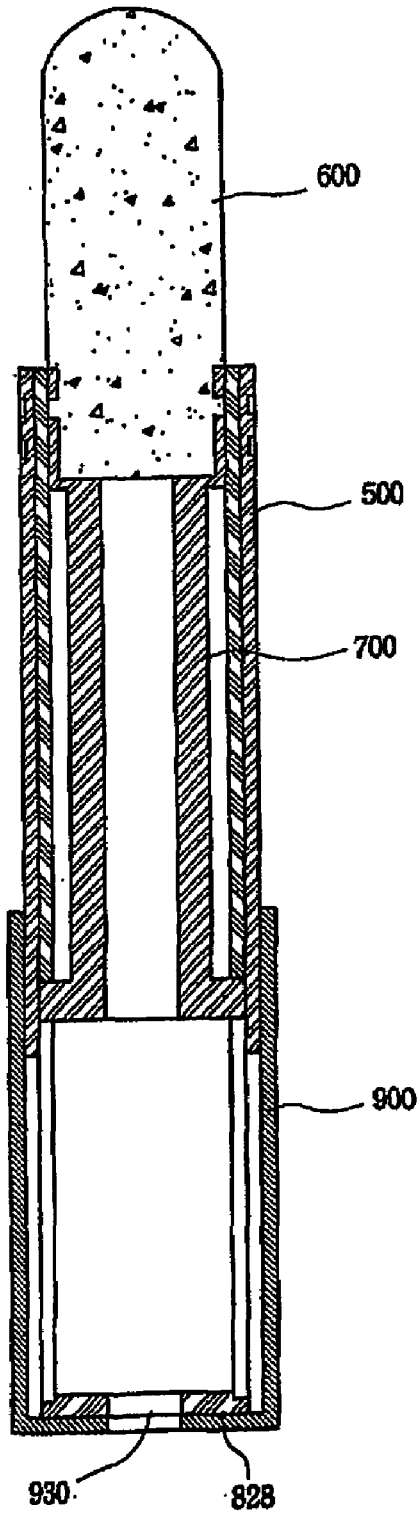
FIG. 11 is a side sectional view of the multipurpose case when a core is withdrawn from the multipurpose case.

FIG. 9 is an exploded perspective view showing a multipurpose case according to another embodiment of the present invention, FIG. 10 is a side sectional view of the multipurpose case shown in FIG. 9 when the multipurpose case is in a state of being assembled, and FIG. 11 is a side sectional view of the multipurpose case when a core is withdrawn from the multipurpose case.

According to the present embodiment, the multipurpose case includes a core 608 having various sectional shapes including triangular, rectangular, polygonal, and oval shapes, an upper body 718 and a lower body 722. In addition, the multipurpose case includes a core fixing section 700 formed at an upper portion thereof with the core 600 and moving the core 600 up and down so as to withdraw the core 600 out of the multipurpose case, a fixing member 800 accommodating the core fixing section 700 therein and guiding the core fixing section 700 when the core fixing section 700 moves up and down, a middle case 500, which is arranged around the fixing member 800 and to which the core fixing section 700 is fixed such that the core fixing section 700 is moved up by using one hand of a user, a lower case 900 accommodating the middle case 500 therein, and an upper lid 400.

Hereinafter, a case used for a cosmetic tool will be described in detail.

When sectional shapes or external appearances of the upper lid 400 and the lower case 900 are formed in a predetermined shape, such as triangular, rectangular, polygonal, and oval shapes, it is preferred to form the core 600 in a predetermined shape corresponding to the shapes of the upper lid 400 and the lower case 900.

In the present embodiment shown in FIGS. 9 to 11, the multipurpose case has a cylindrical shape.

The core fixing section 700 includes the upper body 718 formed with a plurality of fixing holes 716 and the lower body 722 vertically extending from a lower portion of the upper body 718 and formed at both lower sides thereof with wings 720.

The middle case 500 has a cylindrical shape and is formed at an upper peripheral portion thereof with a plurality of slits 514. The slits 514 are provided to prevent the middle case 500 from being slid from user's hand when the user pushes the middle case 500.

The fixing member 800 is formed at both sides thereof with guide slots 824, into which the wings 720 of the core fixing section 700 are inserted in order to slidably moved up and down along the guide slots 824.

A plurality of engagement protrusions 832 are formed at one side of the guide slots 824. Preferably, 3 to 5 engagement protrusions 832 are provided in the guide slots 824. In this case, the wings 720 sequentially make contact with the engagement protrusions 832 while the core fixing section 700 is being moved up and down so that the movement of the core fixing section 700 is periodically stopped.

In addition, as compared with the conventional spiral protrusion or spiral slots, the guide slots 824 can be easily fabricated.

An upper fixing cap 510 is fixedly inserted into the upper lid 400. A touch part 512 is formed at a lower portion of the upper fixing cap 510. The touch part 512 is protruded radially inwards so that a vacuum is formed in the fixing member 800 when the touch part 512 makes contact with an outer peripheral portion of the fixing member 800.

It is preferred to prevent air or moisture from penetrating into the fixing member 800 by allowing the touch part 512 to make contact with the upper end of the fixing member 800. By forming the vacuum state in the case, the core is prevented from being solidified with properly maintaining wet in the core.

The touch part 512 has a semi-circular sectional shape and is preferably protruded radially inwards. However, it is possible to form the touch part 412 in various shapes, such as a polygonal shape or an oval shape, adapted for the case.

Preferably, the touch part 512 is made of rubber or silicon.

A filling hole 830 is formed at a center of a lower fixing cap 828 and a stepped portion 826 is formed at a lower portion of the lower fixing cap 828. The fixing member 800 is vertically installed on the stepped portion 826.

According to the multipurpose case having the above structure, the guide slots 824 of the fixing member 800 can be formed in a long size. Thus, manufacturing and assembling processes of the multipurpose case are very convenient. In addition, the user can withdraw the core using one hand, so it is very convenient for the user to use the multipurpose case.

The conventional case for cosmetic tools and stationery materials is required to have formed a long spiral slot at an inner portion of the case so as to withdraw the core in a long size. For this reason, the case is required to have a relatively long size so as to form the long spiral slot therein. However, it is very difficult to form a long spiral slot in the inner portion of the case. On the contrary, the multipurpose case of the present invention can be slidably moved along the guide slots formed in the fixing member in a simple manner, so that the productivity of the multipurpose case can be improved.

In addition, it is well known to those skilled in the art that upper and lower parts of the multipurpose case of the present invention can be symmetrically formed.

The core fixed to the core fixing section 700 is soft solid material and is exchanged with various kinds of cores, such as a pastel crayon, a solid paste, a perfume pen, a fountain pen, a brush pen, an eye liner, a mascara, and a lip stick.

This is possible by forming the guide slots at both sides of the fixing member 800 in a long size.

INDUSTRIAL APPLICABILITY

As can be seen from the foregoing, the multipurpose case according to the present invention has a simple structure so an assembling process thereof is simplified, so the productivity thereof is improved without a faulty assembly occurring. In addition, manufacturing cost of the multipurpose case can be reduced.

In addition, it is convenient for a user to withdraw the core from the multipurpose case.

Furthermore, the core is hidden in the multipurpose case when it is not used, so a bag storing the multipurpose case is prevented from being contaminated and the core is prevented from making contact with other objects so the life span of the core is expanded.

In addition, the multipurpose case can be widely used as a case of cosmetic tools and stationery materials.

While this invention has been described in connection with what is presently considered to be the most practical and preferred embodiments, it is to be understood that the invention is not limited to the disclosed embodiments and the drawings, but, on the contrary, it is intended to cover various modifications and variations within the spirit and scope of the appended claims.

The invention claimed is:

1. A multipurpose case able to allow withdrawal of a core, accommodated therein and consisting of cosmetic tools or stationery materials, to an exterior for use, the multipurpose case comprising:

a case including a first supporting section coupled to a first tube having a cylindrical shape with a predetermined length, connection members vertically extending upwards from both sides of an upper surface of the first supporting section, and a second supporting section formed at upper ends of the connection members and inserted into a second tube having an outer diameter smaller than an outer diameter of the first tube; and a core fixing section coupled to a lower end of the third tube arranged between the first and second tubes coupled to the case so as to withdraw the core provided at an upper end thereof to the exterior by gripping and pulling upwards the third tube.

2. A multipurpose case as claimed in claim 1, further comprising a lid coupled to an outer peripheral portion of the third tube coupled to the core fixing section.

3. A multipurpose case as claimed in claim 1, wherein the core fixing section includes a guide member formed at both sides thereof with guide slots for allowing the core fixing section to move along the connection members, a vertical member vertically connected to a center of the guide member while passing through a center of the second supporting section, and a supporting member formed at an upper end of the vertical member so as to be coupled with a core supporting section having the core.

4. A multipurpose case used as a case of cosmetic tools and including an upper lid, a middle case and a lower case, the multipurpose case comprising:

a fixing member formed at both sides thereof with guide slots, which are vertically formed, and having a plurality of engagement protrusions formed at one side of the guide slots;

a core fixing section including an upper body for fixing a core thereto and a lower body formed at a lower portion of the upper body and having wings, the core fixing section being coupled to the fixing member such that the wings are moved along the guide slots; and an upper fixing cap fixed to an inner ceiling surface of the upper lid and including a touch part making contact with an upper peripheral portion of the fixing member so as to seal the fixing member.

5. A multipurpose case as claimed in claim 4, wherein a plurality of slits are formed at an outer peripheral portion of an upper end of the middle case so as to allow a user to easily withdraw the core by using one hand of the user.

6. A multipurpose case as claimed in claim 4, wherein the touch part is protruded radially inwards so as to seal the fixing member by making contact with the fixing member and made of rubber or silicon.

7. A multipurpose case as claimed in claim 1 or 4, wherein the core is any one selected from the group consisting of a lip liner, a lip stick, a stick foundation, and a blusher brush.

8. A multipurpose case as claimed in claim 1 or 4, wherein the core is any one selected from the group consisting of a ball-point pen, a pastel crayon, a color pencil, a blade and a gimlet.

* * * * *